US010946936B2

(12) United States Patent
Miller

(10) Patent No.: US 10,946,936 B2
(45) Date of Patent: Mar. 16, 2021

(54) ROPE GUIDE APPARATUS

(71) Applicant: Steven Maurice Miller, Ravensthorpe (GB)

(72) Inventor: Steven Maurice Miller, Ravensthorpe (GB)

( * ) Notice: Subject to any disclaimer, the term of this patent is extended or adjusted under 35 U.S.C. 154(b) by 213 days.

(21) Appl. No.: 16/038,172

(22) Filed: Jul. 17, 2018

(65) Prior Publication Data

US 2019/0023355 A1 Jan. 24, 2019

(30) Foreign Application Priority Data

Jul. 18, 2017 (GB) ..... 1711515

(51) Int. Cl.
*B63B 21/04* (2006.01)
*B63B 21/54* (2006.01)
*B65H 57/12* (2006.01)

(52) U.S. Cl.
CPC ..... *B63B 21/04* (2013.01); *B63B 21/54* (2013.01); *B65H 57/12* (2013.01); *B65H 2701/35* (2013.01)

(58) Field of Classification Search
CPC ..... B63B 21/04; B63B 21/54; B65H 57/12; B65H 2701/35
See application file for complete search history.

(56) References Cited

U.S. PATENT DOCUMENTS 3,224,404 A * 12/1965 De Jong ..... B63B 21/54 114/230.25
3,878,808 A 4/1975 Mock
4,667,617 A 5/1987 Molitor
5,586,514 A 12/1996 Yuscavage
2004/0237867 A1 12/2004 Dunn
2012/0228891 A1 9/2012 Howard et al.

FOREIGN PATENT DOCUMENTS

DE 20200120 5/2003
GB 2426965 12/2006
WO WO2012/119202 9/2012

OTHER PUBLICATIONS

Extended European Search Report dated Nov. 6, 2018 issued in European Patent Application No. 180060.25 which claims priority from UK Application No. GB1711515.5 (the subject U.S. patent application also claims priority from UK Application No. GB1711515.5), pp. 1 to 8 (NPL1).

* cited by examiner

*Primary Examiner* — Stephen P Avila
(74) *Attorney, Agent, or Firm* — Merek, Blackmon & Voorhees, LLC

(57) ABSTRACT

A rope guide apparatus to assist with mooring a vessel comprises an elongate pole and a length of rope. The length of rope is slidably retained by the elongate pole at a first point of retention adjacent a first end of the pole. The rope extends from the first point of retention towards a second end of the pole where it is slidably retained by the pole at a second point of retention adjacent the second end. The rope extends from the second end of the pole back towards the first end and is slidably retained at a third point of retention, with the rope extending freely from the pole. This apparatus allows easier one-person mooring of a vessel by looping the rope over a bollard and avoids the need for the individual to lean out of a vessel when attempting to moor at a distance.

11 Claims, 7 Drawing Sheets

ROPE GUIDE APPARATUS

BACKGROUND OF THE INVENTION

1. Field of the Invention

The present invention relates to a rope guide apparatus. More particularly, the present invention relates to a rope guide apparatus configured as a boat mooring line apparatus.

2. Description of the Related Art

In many applications it is desirable to attach a rope to an object that is beyond a person's reach. A particularly common circumstance in which a person may wish to attach a rope to an object beyond their reach is when mooring a boat, when a boatman standing on a boat may wish to attach a mooring rope to a mooring fixture on the dock.

The process of docking or mooring a vessel generally requires that a docking or mooring line be thrown by the boatman from the boat to dock personnel on the dock, which dock personnel may then secure the end of the line to a mooring fixture such as a mooring piling or dock cleat. The mooring line may then be used to draw the vessel closer to the dock, at which time further mooring lines may be secured as required.

However, in some circumstances, considering in particular the docking of a small vessel such as a pleasure craft, dock personnel to whom a rope could be thrown may not be available. Moreover, a small vessel such as a pleasure craft may often be 'single-handed', i.e. comprise only a single crew member, and in the absence of additional crew members the helmsman may himself be required to perform the additional operation of attaching the mooring line to the mooring fixture.

When attaching a docking line to a mooring fixture in the absence of dock personnel, the boat personnel may be required to jump from the boat to the dock whilst holding a free end of a mooring rope. This presents a first problem inasmuch that the helmsman is required to manoeuvre the boat sufficiently close to the dock, whilst avoiding striking the dock, that the crew member may jump between the boat and the dock. It will be appreciated that jumping from the boat in this manner, and in particular if mooring a boat having a relatively high freeboard, is an unsafe practice which may result in the boatman falling from the boat. Moreover, problems associated with attaching a mooring line to a mooring point are particularly exasperated in a one-man crew situation, in which instance the helmsman may find it difficult or impossible to attach the mooring line to the mooring point.

Accordingly, it is desirable to provide an apparatus that more easily allows for attachment of a rope to an object that is beyond a person's reach, and in particular to allow for the attachment of a boat mooring line to a mooring fixture, such as a mooring piling or cleat, which obviates the above mentioned problems.

BRIEF SUMMARY OF THE INVENTION

According to a first aspect of the present invention, there is provided a rope guide apparatus; the apparatus comprising an axially elongated pole having first and second ends; and a length of rope having first and second ends; in which said length of rope is slidably retained by said elongated pole at a first point of retention located adjacent said first end of said elongated pole from which point said first end of said rope extends freely from said axially elongated pole, and in which said rope is arranged to extend from said first end thereof towards said second end of said elongated pole and is slidably retained by said elongated pole at a second point of retention adjacent said second end thereof, and in which said rope is arranged to extend continuously from adjacent said second end of said elongated pole towards said first end of said elongated pole and is slidably retained by said elongated pole at a third point of retention located at said first end of said elongated pole or intermediate said first and second ends of said elongated pole, and in which said second end of said length of rope extends freely from said axially elongated pole.

Preferably, said elongated pole is substantially rigid along its length.

Preferably, said third point of retention is located between said second end of said elongated pole and the mid-point of said elongate pole between said first and second ends.

Preferably, said length of rope is slidably retained by said elongated pole at each point of retention such as to allow said rope to slide relative to said point of retention generally parallel to the axis of said pole and so as to retain the rope close to or within the elongated pole at each point of retention.

Preferably, at least said third point of retention is defined by a retaining fixture.

Preferably, said retaining fixture is formed by a protrusion defined by said elongated pole which protrusion is shaped to slidably retain said length of rope at the point of retention.

Preferably, at least said third point of retention is an eyelet and said rope is arranged to pass through each said eyelet.

Preferably, said elongated pole is an elongated tube having first and second open ends and defining internally an axial bore extending therebetween.

Preferably, said length of rope is arranged to extend at least partly within said elongated tube along said axial bore, and is arranged such that said first end of said rope extends freely outwardly of said first open end of said elongated tube, and such that said second end of said rope extends outwardly of said second open end of said elongated tube and continuously therefrom towards said first end of said elongated tube.

Preferably, said length of rope is arranged such that said rope extends outwardly of said elongated tube and continuously therefrom towards said first end of said elongated tube external to said elongated tube.

Preferably, said elongated tube defines an eyelet at said third point of retention protruding radially outwardly of the outer surface of the elongated tube.

Preferably, said elongated pole is comprised of a plurality of discrete pole sections.

Preferably, said plurality of discrete pole sections are configured to be readily separable and attachable.

Preferably, said plurality of discrete pole sections are configured to be readily attachable by way of partial insertion of an end of a first pole section into an open end of a second pole section.

Preferably, said apparatus is configured as a boat mooring line apparatus.

According to a second aspect of the present invention, there is provided a boat mooring line apparatus; the apparatus comprising: a substantially rigid axially elongated tube having first and second open ends; and a length of rope having first and second ends; in which said length of rope is arranged to partly extend within said tube along said axial bore, and is arranged such that said first end of said rope extends freely outwardly of said first open end of said elongated tube, and such that said second end of said rope extends outwardly of said second open end of said elongated tube and continuously therefrom towards said first end of said elongated tube external to said elongated tube, and in which said length of rope is slidably retained by a retaining fixture protruding outwardly of the outer surface of the elongated tube located intermediate said second open end and said midpoint of said elongated tube, and in which said second end of said length of rope extends freely from said axially elongated tube.

BRIEF DESCRIPTION OF THE DRAWINGS

The invention will now be described by way of example only with reference to the accompanying drawings, which are purely schematic and not to scale, of which.

DETAILED DESCRIPTION OF EXAMPLE EMBODIMENTS

FIG. 1

Figure 1:
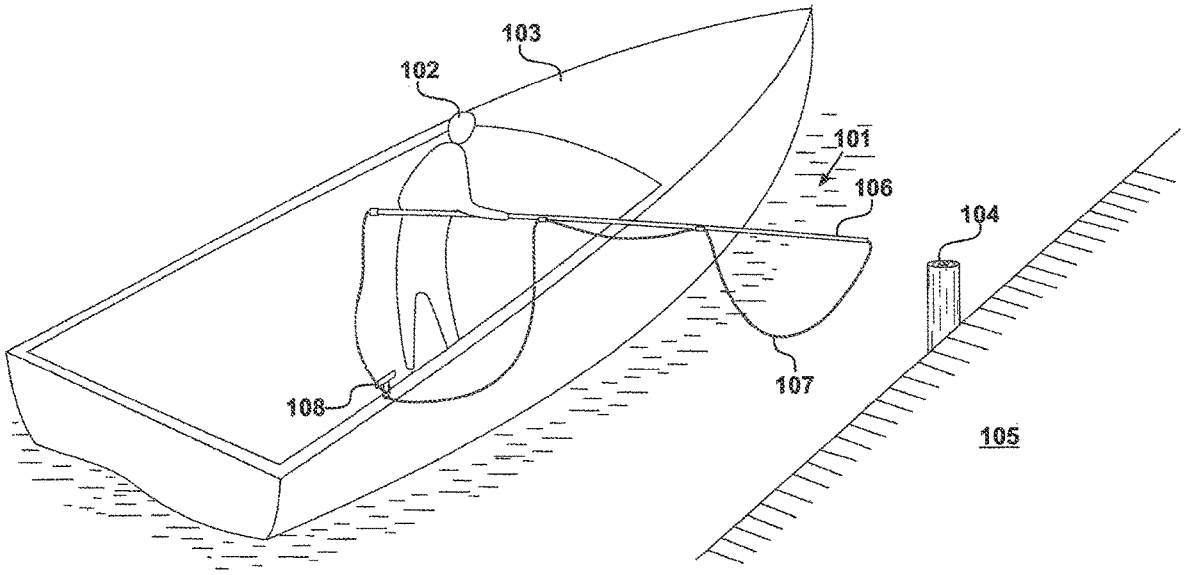
FIG. 1 shows an example of an environment in which the present invention can be used.

An example of an environment in which a boat mooring line apparatus according to a specific embodiment of the present invention can be used is illustrated in a perspective view in FIG. 1.

Referring to the Figure, a boat mooring line apparatus 101 according to one embodiment of the present invention is being used by a boatman 102 aboard boat 103 to attach the boat 103 to a mooring fixture, in the specific example to the mooring piling 104, fixed to dock 105. As will be described in further detail in relation to later Figures, boat mooring line apparatus 101 comprises principally of a substantially rigid elongated pole 106 and a length of mooring line rope 107 guided by the pole 106 so as to extend substantially the length of the pole.

It will of course be appreciated that, whilst in the specific example of the invention described in detail herein, boat mooring line apparatus 101 is shown being used to attach a rope about mooring piling 104, in practice boat mooring line apparatus 101 could be used to attach a rope about any mooring point fixture. In particular, it will be appreciated that, in certain territories, for example, the United Kingdom, a more common form of mooring point fixture is a 'cleat', usually constructed of metal. It will be appreciated that boat mooring line apparatus 101 may be used to attach a mooring line rope to a variety of different forms of mooring point fixtures, including both traditional pilings and the more modern cleat.

Thus, as shown in the Figure, the boatman 102 may guide the boat 103 under its own power towards the dock 105 to bring the boat 103 near and generally parallel to the dock 105. The boatman may then lean outwardly of the boat with mooring line apparatus 101, grasping one end of pole 106, and using pole 106 to guide the loop of mooring rope 107 over mooring piling 104. As illustrated in the Figure, the free ends of mooring line rope 107 may be secured to the boat 103, for example, to the mid ship cleat 108 of the boat 103, so as to attach the boat 103 to the dock 105 by the loop of mooring line 107.

It will of course be appreciated however that, although a rope guide apparatus according to the present invention may find particular utility when configured as a boat mooring line apparatus for mooring a boat, it is not limited in its utility to such an application. Rather, a rope guide apparatus, possibly similar in construction to mooring line apparatus 101, may be used for attaching a loop of rope to an object in other situations, for example, for a person standing on a dockside to attach a loop of rope about an object floating in water adjacent the dock, to thereby allow retrieval of the object. In a particular alternative example, a rope guide apparatus according to one alternative embodiment of the present invention might be configured for use for rescue purposes, for example, to be used by rescue personnel aboard a rescue vessel to retrieve a person floating in the water. As a still further alternative example, a rope guide apparatus might be used by ground personnel for steadying of a structural beam being lowered into position by a crane.

Figures 2A, 2B, 2C:
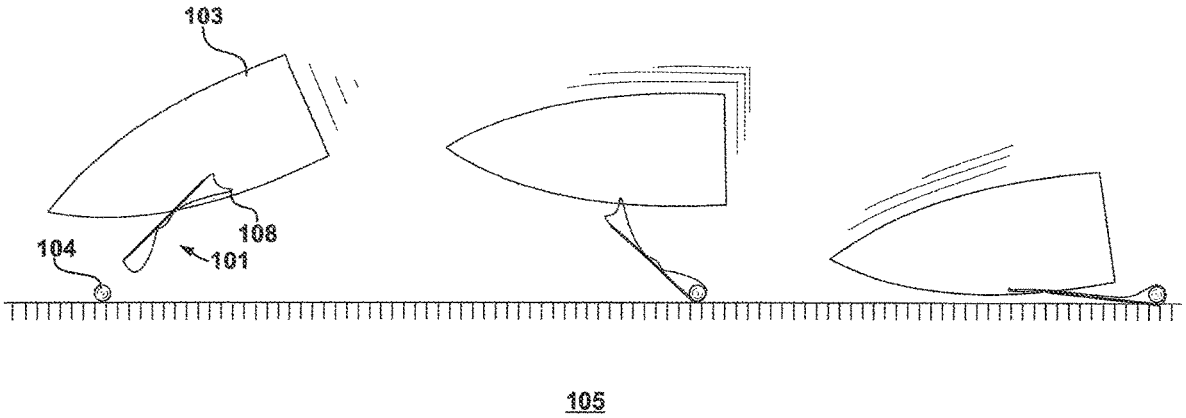
FIGS. 2*a*, 2*b* and 2*c* show a method of using a boat mooring line apparatus according to an embodiment of the present invention.

FIGS. 2*a*, 2*b* & 2*c*

A method of using the mooring line apparatus previously identified in FIG. 1 to moor boat 103 is illustrated schematically in FIGS. 2*a*, 2*b* and 2*c*.

Referring to the Figures, the situation of boat 103 in FIG. 2*a* is broadly similar to the positioning of the boat 103 in FIG. 1. Thus, referring to FIG. 2*a*, as previously described, the helmsman may position the boat under its own power close, and generally parallel to, the dock 105. Having attached the free ends of the mooring line rope 107 of the mooring line apparatus 101 to, for example, the mid-ship cleat 108 of the boat, the boatman may then lean outwardly of the boat grasping elongated pole 106 as to loop the end of the mooring line rope about the mooring piling 104.

Once the mooring line rope is looped about the mooring piling 104, as in FIG. 2*b*, the boatman may then let go of pole 106 and, typically by applying forward thrust using the boats engine or other propulsion means, manoeuvre the boat under power to tension the loop of mooring line 107, and so control the position of the boat relative to the dock.

Thus, as shown in FIG. 2*c*, by using the boats engine to drive the boat forward to tension the mooring line rope 107, the boat will tend to be drawn gently towards the dock side 105. In this respect, in the illustrated example mooring line apparatus 101 is being used in the manner of a 'spring'. The boatman may then attach further mooring line ropes as desired without the requirement to lean excessively outwardly of the boat or to jump a large gap between the boat and the dockside. Moreover, in the case of a one-man crewed boat, the lone boatman may, having attached the mooring line apparatus 101 and having manoeuvred the boat towards the position shown in FIG. 2C, set the boats engine to continue providing gentle forward thrust, thereby pinning the boat against the dockside, whilst disembarking the boat safely to attach further mooring lines as required.

FIGS. 3*a*, 3*b*, 3*c*, 3*d* and 3*e*

Figure 3A:
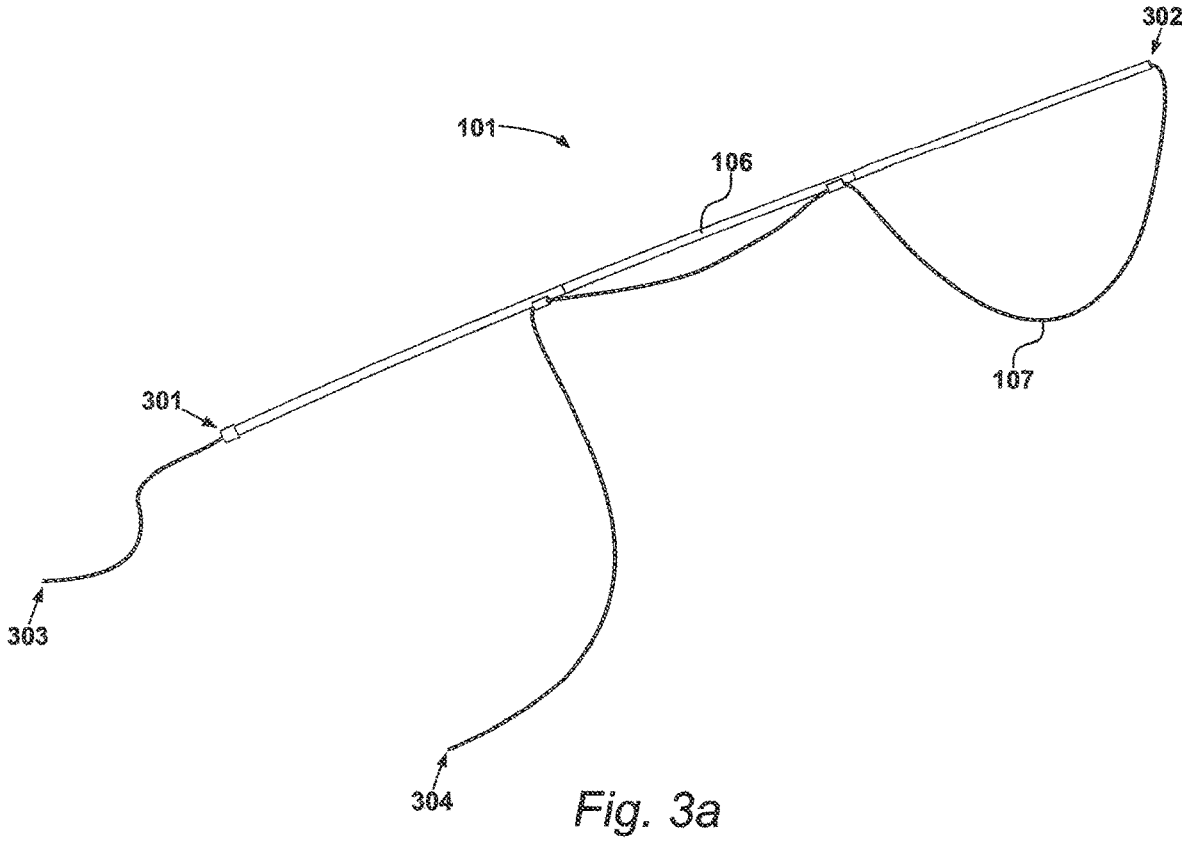
FIGS. 3*a*, 3*b*, 3*c*, 3*d* and 3*e* show the boat mooring line apparatus previously identified in FIGS. 2*a*, 2*b* and 2*c* in perspective, side elevation, side cross sectional, exploded and close-up end views respectively.
Figure 3B:
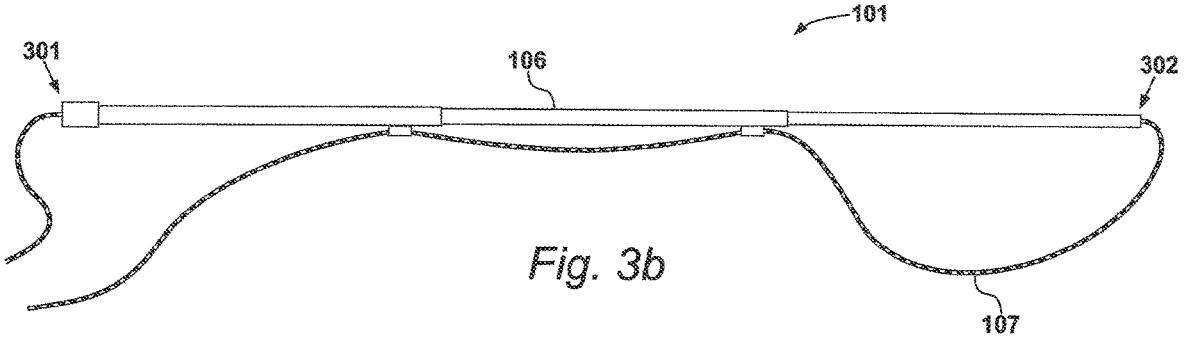
Figure 3C:
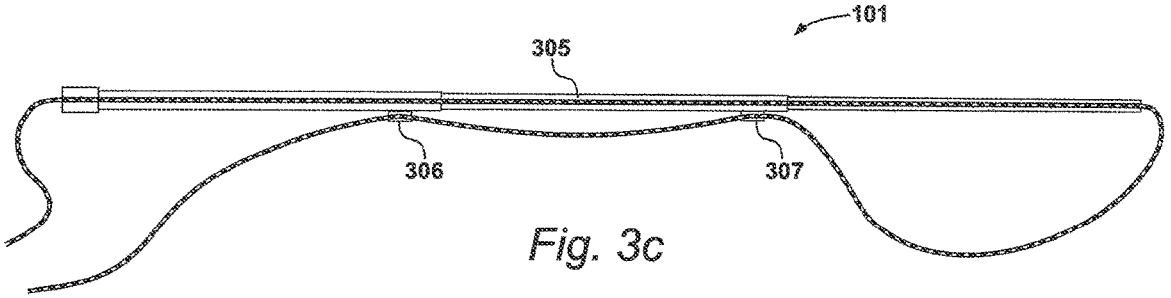
Figure 3D:
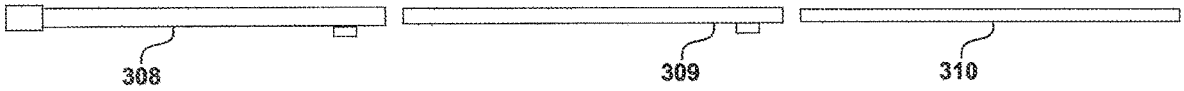
Figure 3E:
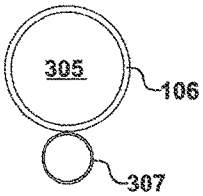

Mooring line apparatus 101 is shown in a close up perspective view in FIG. 3*a*, a side elevation view in FIG. 3*b*, a side cross-sectional view in FIG. 3*c*, a partially exploded view in FIG. 3*d*, and in a close-up end view in FIG. 3*e*.

As previously described, in the specific embodiment the rope guide apparatus is configured as a boat mooring line apparatus 101 suitable for mooring of boats, and comprises principally of an axially elongated pole 106 having first and second ends 301, 302 respectively, and a length of mooring line rope 107 having first and second free ends 303, 304 respectively. In the embodiment, said rope 107 is comprised of braided strands of a polyester plastics materials, but it will of course be appreciated could be comprised of alternative materials, such as textile strands or metallic wires. In essence, rope 107 should be flexible and sufficiently strong as to not be broken when relatively high tensile forces are exerted thereon.

As will be described, in the specific embodiment, pole 106 is an axially elongated hollow tube, the first and second ends 301, 302 of which are open, and which are communicated by an axial bore 305 extending the full length of the tube between the first and second open ends. In the embodiment, elongated tube 106 is constructed of a carbon-fibre reinforced plastics material, which construction is selected for its advantageous combination of strength, high rigidity, and low weight. In the embodiment, elongated tube 106 is constructed so as to be substantially rigid along its length, such that the tube may conveniently guide and support the mass of rope 107 without undergoing excessive distortion. It will of course be appreciated that tube 106 could alternatively be constructed of other materials, for example, a homogenous plastics materials, wood, or metal.

Thus, referring to the drawings, in the embodiment the boat mooring line apparatus 101 comprises axially elongated tube 106 having first and second open ends 301, 302, tube 106 defining internally an axial bore 305 extending therebetween, and a length of flexible mooring line rope 107. Said flexible mooring line rope 107 is arranged such that approximately a first half of its length extends from the first end 301 to the second end 302 of the tube 106, and a second half of its length extends in the opposite direction, such that both ends 303, 304 of the rope 107 extend freely from the tube 106. Rope 107 is thus supported by tube 106 so as to generally form a closed loop, in which both free ends of the rope are returned generally towards the first end of the tube 106.

Referring in particular to FIG. 3*c*, it can be seen that said length of rope 107 is arranged to enter the axial bore 305 of tube 106 through said first open end 301, and that said first end 303 of said rope 107 is arranged to extend freely therefrom so as to be suitable for attaching to an anchor point, for example, the mid-ship cleat 108 of boat 103. Rope 107 is slidably retained within said elongated tube 106 adjacent the first end 301 by the walls of the tube 106, which act to retain the rope 107 within the tube 106 from the point at which the rope 107 enters the tube 106 at the first open end 301, to the point at which the rope 107 exits the tube 106 at the second end 302. Thus, in the embodiment, said rope 107 is slidably retained within said tube 106 along the full length of the portion of rope 107 that extends within the axial bore 305 of tube 106.

As shown in the drawings, said rope 107 is arranged so as to extend outwardly of the second open end 302 of the tube 106, and then return backwardly generally towards the first open end 301 externally to the tube 106. Thus, as illustrated, said rope 107 is arranged to extend outwardly of the second end 302 of the tube 106 and continuously therefrom generally towards said first end 301 of said pole 106 towards retaining fixture 307.

In the specific embodiment, retaining fixture 307 takes the form of an eyelet protruding radially outwardly of the outer surface of the tube 106, and through which the rope 106 passes to thereby slidably retain the rope 107 close to the tube 106 at the point of the eyelet 307. Eyelet 307 is located between said first and second ends 301, 302 of said tube 106, in the specific embodiment, eyelet 307 is located between said second end 302 of said tube 106 and the midpoint of said tube 106. As illustrated, said rope 107 is not retained relative to the tube 107 between the second open end 302 of the tube 106 and the retaining eyelet 307, and thus the rope 106 is allowed to hang freely between the second open end 302 of the tube 106 and the eyelet 307 thereby defining a loose loop.

In the specific embodiment, tube 106 comprises a further eyelet 306 positioned intermediate the midpoint of the tube 106 and said first open end 301. Thus, as illustrated, in the embodiment rope 107 is arranged to pass through eyelet 306 after passing through eyelet 307 so as to slidably retain rope 107 close to the tube 106, and rope 107 is arranged to extend freely from eyelet 306. Eyelet 306 ensures that the second free end 304 of rope 107 is returned generally towards the first end 301 of the tube 106 rather than hanging freely from the eyelet 307.

Thus, as described, said rope 107 is arranged as a loop, slidably retained with respect to the tube 106, such that the rope is guided to extend through tube 106, entering through said first open end 301, exiting the tube through the second open end 302, and being guided back towards the first end 301 by way of eyelets 306 and 307. In this way, both free ends of said rope 107 will tend to fall naturally proximal the first end 301 of the tube 106.

Rope 107 is advantageously slidably retained with respect to said tube 106, firstly by the internal wall of said tube 106, and subsequently by said eyelets 306 and 307, such that the rope 107 is retained close to or within the tube 106 at the points of retention, but such that rope 107 may readily slide with respect to tube 106 in a direction generally parallel to the axis of said tube 106. Specifically, in the example, said rope 107, said axial bore 305, and said eyelets 306 and 307, are dimensioned such that the cross-sectional width of the rope 107 is substantially less than the width of said axial bore 305 and of the apertures of eyelets 306 and 307. In this way, rope 107 may readily slide relative to each of the points of retention, with each point of retention only exerting minimal frictional resistance on the rope. In the specific example, axial bore 305 has a cross-sectional width of approximately 40 millimetre, the apertures of eyelets 306, 307 a width of approximately, 20 millimetre, and rope 107 a width of approximately 15 millimetre, although it will of course be appreciated that these dimensions may be varied in the case of alternative embodiments of the invention.

As described, rope 107 is arranged so as to form a continuous loop between said first and second free ends 303, 304, with both free ends 303, 304 being supported generally proximal the first end 301 of the tube 106. Moreover, as described, rope 107 is slidably retained about the loop to tube 106, and may slide freely relative to tube 106, through said tube 106 and the apertures of said eyelets 306 and 307, along an axis generally parallel to the axis of tube 106. That both free ends 303, 304 of said rope 107 extend freely and are not secured to the tube 107, and that the rope is allowed to slide freely relative to the tube 106, advantageously means that the rope 107 does not exert any tension on the tube 106 when the rope is attached to an object, for example, to a mooring point, rather, all tension is borne solely by the rope 107.

It will be appreciated then that a benefit of the claimed arrangement is that the tube 106 serves solely as a guide for the rope 107, which in the specific embodiment may be used to guide the loop of rope 107 formed between the second open end 302 of the tube 106 and the first eyelet 307 about a mooring point. As neither end of the rope 107 is secured to the tube 106, and as the rope 107 may slide freely through the tube 106 and the eyelets 306, 307, tensioning of the rope 107, as would occur when the apparatus is being used to moor a boat in the manner previously described with reference to FIGS. 2*a* to 2*c*, does not exert any tension or other significant force on tube 106.

As a result, tube 106 may have a relatively lighter weight construction, as it is required to resist deformation or breakage only to relatively low applied loads. It will be appreciate that, were one or more ends of rope 107 secured to tube 106, for example, secured to tube 106 proximal the second end 302 so as to form the loop, or if the rope were statically, rather than slidably, retained to the tube, then tube 106 would be required to resist the full tensile load exerted on the rope between the boat and the dock, and so would be required to have a stronger, and thus likely heavier, construction.

Further, that rope 107 is guided by tube 106 so as to form a loop, with both free ends 303, 304 of the rope 107 hanging freely from the tube 106, allows a relatively weaker/thinner rope to be used, as the tension exerted on the rope during mooring is divided equally between the two halves of the rope. It will be appreciated that a disadvantage of using a single length of rope, potentially arranged to extend through the tube 107 and forming a closed loop at the end of the single length, is that a relatively stronger, and so likely thicker, rope would be required. Moreover, as will be described with particular reference to FIGS. 5*b* and 5*c*, the arrangement of rope 107 as a continuous loop more easily allows for a loop of the rope formed adjacent to the second end of the tube 106 to be looped about a mooring fixture, such as mooring piling 104. It will be appreciated that, a disadvantage of an apparatus in which a single length of rope is arranged to form a closed loop at the end of the single length adjacent the second end of the tube, is that difficulties may be encountered when using the apparatus in keeping the 'loop' open, and so allowing it to be placed about a mooring fixture.

Indeed, referring in particular to FIG. 3*d*, in the specific embodiment, said tube 106 is comprised of a plurality of discrete pole sections, in the example, three discrete pole sections, 308, 309, 310. The plurality of discrete pole sections 308 to 310 are configured to be readily separable and attachable from one another, the pole sections being configured to be readily attachable by way of partially inserting an end of a first pole section into an open end of a second pole section, the ends of the respective pole sections being dimensioned so as to be retained by way of an interference fit. It will be appreciated that such a modular construction of tube 106 would likely be unsuitable if the tube were required to transmit significant tensile forces.

A particular advantage of this modular construction of said elongated tube 106 is that the overall length of the tube may be readily increased or decreased simply by adding or removing additional pole sections from the end of the tube. Thus, as an example, in the event that the mooring line apparatus is to be used to moor a relatively large boat, it may be desirable for the elongated tube 106 to be relatively longer in length than a mooring apparatus used for mooring of a relatively small pleasure craft.

As an alternative to the readily separable and attachable discrete pole sections illustrated in FIG. 3*d*, the tube 106 could alternatively be constructed so as to allow the sections of the pole to slide telescopically between respective retracted and extended positions, so as to allow the overall length of the tube 106 to be readily increased or decreased by telescoping the pole sections.

Figure 4A:
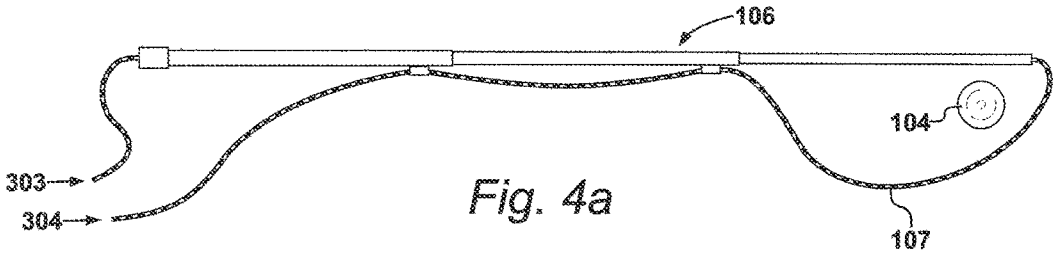
FIGS. 4*a* and 4*b* show the boat mooring line apparatus in side views being used to attach a rope about a mooring piling.
Figure 4B:
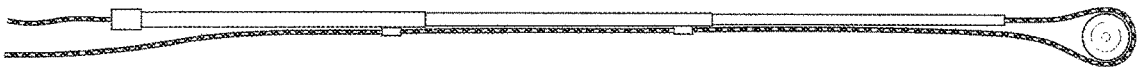

FIGS. 4A and 4B

A method of using the boat mooring line apparatus 101 is shown in FIGS. 4*a* and 4*b*.

Referring to the Figures, the condition of the boat mooring line apparatus in FIG. 4*a* generally corresponds to its condition as shown previously in FIGS. 1 and FIG. 2*a*. Thus, as previously described, when the boatman is bringing the boat alongside the dock, he may prepare the mooring line apparatus such that the mooring line rope 304 forms a loose loop between the second open end 302 of the tube 106 and the eyelet 307. The boatman may then manoeuvre this loop of line over the mooring piling 104, with the free ends 303, 304 of the rope 107 attached to a cleat on the boat.

Referring then to FIG. 4B, as previously described in relation to FIGS. 2*b* and FIG. 2*c*, the boatman may then let go of the elongated tube 301, and manoeuvre the boat so as to bring the mooring line rope 107 under tension. Thus, as illustrated in FIG. 4B, because of the arrangement of mooring line rope 107 with respect to elongated tube 106, and in particular because both free ends 303, 304 of said rope 107 are attached to the boat, even when the mooring line rope 107 is in the tensioned condition as shown in FIG. 4*b*, the tensioned rope does not exert any significant force on tube 106. Rather, as previously described, in this arrangement, tube 106 serves merely as a guide for the rope when in the un-tensioned condition, and, given that the rope 107 may slide freely relative to tube 106 through the axial bore 305 and the eyelets 306, 307, the tube 106 itself is not tensioned by the rope 107 even when the rope 107 is under tension.

Figures 5A, 5B, 5C:
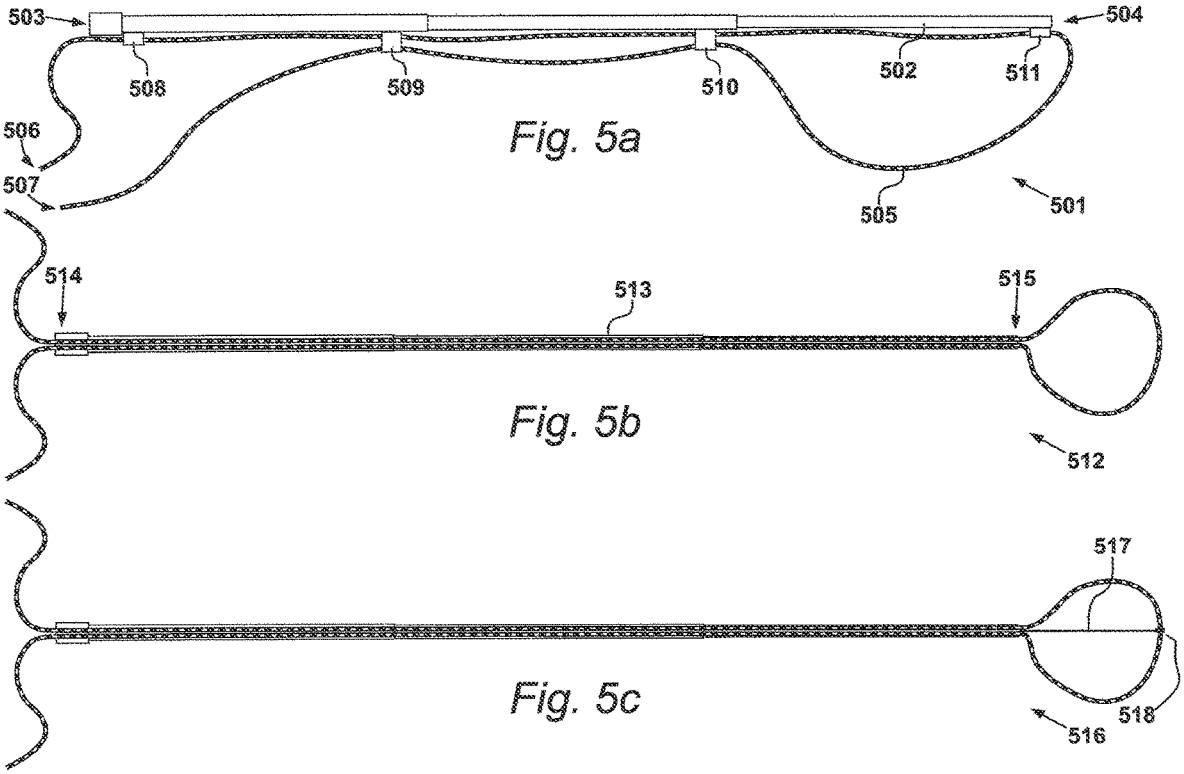
FIGS. 5*a*, 5*b* and 5*c* show second, third and fourth versions of a boat mooring line apparatus according to alternative embodiments of the present invention.

FIGS. 5A, 5B and 5C

Alternative embodiments of a boat mooring line apparatus according to the present invention are shown in FIGS. 5*a*, 5*b* and 5*c*.

Referring firstly to FIG. 5*a*, a first alternative embodiment 501 of a boat mooring line apparatus is shown in a slide elevation view. Referring to the Figure, as illustrated, boat mooring line apparatus 501 has a substantially similar construction to boat mooring line apparatus 101 previously illustrated with respect to FIGS. 1 to 4, in as much that it comprises principally of a substantially rigid elongated pole 502 having first and second ends 503, 504, and a length of mooring line rope 505 having first and second ends 506, 407 respectively. In this embodiment, said rope 503 is arranged to extend in both directions externally to the pole 502, rather than extending partly through the pole.

In this embodiment, pole 502 is provided with a plurality of retaining fixtures 508 to 511, each in the form of an eyelet extending radially outwardly of the outer surface of pole 502, which eyelets slidably retain the rope 505 close to the pole 502 at each position. Thus, eyelet 508 is located adjacent said first end 503 of said pole 502, from which point said first end 506 of said rope 505 extends freely, and eyelet 511 is located adjacent said second end 504 of said pole 502, and rope 505 is arranged to extend between said eyelets 508 and 511, being slidably retained intermediate the first and second ends 503, 504 of the pole 502 by intermediate eyelets 509, 510. From eyelet 511 rope 505 is arranged to extend continuously towards the first end 503 of the pole, and is slidably retained by intermediate eyelets 510 and 509, from which eyelets the second end 507 of rope is allowed to extend freely from the pole 502.

Referring secondly to FIG. 5*b*, a second alternative embodiment 512 of a boat mooring line apparatus is shown in a side-cross sectional view. Referring to the Figure, it will be noted that apparatus 512 is substantially similar in construction to apparatus 101 described previously with reference to FIGS. 1 to 4, inasmuch that it comprises an axially elongated rigid tube 513 having first and second open ends and defining internally an axial bore extending therebetween.

It will be noted that the principal difference between apparatus 512 and apparatus 101 is that the rope of apparatus 512 is routed through the axial bore of tube 513 both in a first direction from the first end 514 of the tube towards the second end 515, and in the reverse direction. Accordingly, given that both halves of the rope are slidably retained internally by the tube 513, tube 513 is not provided with externally protruding retaining fixture, such as the retaining eyelets of apparatus 101.

Referring finally to FIG. 5*c*, a third alternative embodiment 516 of a boat mooring line apparatus is shown in a side cross sectional view. It will be noted that the apparatus 516 is substantially similar in construction to apparatus 512, and like components will be referenced using like numerals. Apparatus 516 is however further provided adjacent the second end 515 of said pole 513 with a strut 517, which strut comprises an eyelet 518 through which the rope slidably passes. As will be appreciated, the primary purpose of strut 517 is to hold open the loop of rope formed adjacent the second end 515 of the pole 513 to more easily allow for the loop to be passed over a mooring point, such as mooring piling 104 described with reference to FIG. 1.

It will of course be appreciated that, like apparatus 101, apparatus according to the present invention taking the form of any of apparatus 501, 512, and 516 are not strictly limited in their utility to use as a boat mooring line apparatus. Rather, more broadly, may find utility for guiding a rope about any object in a number of different environments.

What I claim is:

1. A rope guide apparatus; the apparatus comprising:

an elongate pole having first and second ends; and a length of rope having first and second ends; in which said length of rope is slidably retained by the elongate pole at a first point of retention located adjacent the first end of the elongated pole from which point the first end of said rope extends freely from the elongate pole, and within which the rope is arranged to extend from the first end thereof towards the second end of the elongate pole and is slidably retained by the elongate pole at a second point of retention adjacent the second end thereof, and in which the rope is arranged to extend continuously from adjacent the second end of the elongate pole backwardly towards the first end of the elongate pole externally to said elongate pole and is slidably retained by retaining fixture located intermediate the second end of the elongate pole and a midpoint of the elongate pole, and in which the second end of the length of rope extends freely from the retaining fixture and the elongate pole.

2. The rope guide apparatus of claim 1, in which said elongate pole is substantially rigid along its length.

3. The rope guide apparatus of claim 1, in which the length of rope is slidably retained by the elongate pole at each point of retention such as to allow the rope to slide relative to the respective point of retention generally parallel to a longitudinal axis of the pole while retaining the rope close to or within the elongate pole at each point of retention.

4. The rope guide apparatus of claim 1, in which the retaining fixture is formed by a protrusion extending from the elongate pole, said protrusion is shaped to slidably retain the length of rope at the respective point of retention.

5. The rope guide apparatus of claim 1, in which the retaining fixture comprises an eyelet and the rope is arranged to pass through said eyelet.

6. The rope guide apparatus of claim 1, in which said elongate pole comprises an elongate tube having first and second open ends and defining internally an axial bore extending therebetween.

7. The rope guide apparatus of claim 6, in which the length of rope is arranged to extend at least partly within said elongate tube along said axial bore and is arranged such that the first end of the rope extends freely outwardly of the first open end of the elongate tube, and such that the second end of the rope extends outwardly of the second open end of the elongate tube and continuously therefrom towards the first end of the elongate tube.

8. The rope guide apparatus of claim 7, in which the length of rope is arranged such that the rope extends outwardly of the elongate tube and continuously therefrom towards said first end of said elongate tube external to said elongate tube.

9. The rope guide apparatus of claim 1, in which the elongate pole comprises a plurality of discrete pole sections.

10. The rope guide apparatus of claim 9, in which the plurality of discrete pole sections are configured to be readily separable and attachable.

11. The rope guide apparatus of claim 10, in which the plurality of discrete pole sections are configured to be readily attachable by way of partial insertion of an end of a first pole section into an open end of a second pole section.

* * * * *